US006232925B1

(12) United States Patent
Fujikawa

(10) Patent No.: US 6,232,925 B1
(45) Date of Patent: May 15, 2001

(54) ANTENNA DEVICE

(75) Inventor: Hiroshi Fujikawa, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 09/431,693

(22) Filed: Nov. 1, 1999

(30) Foreign Application Priority Data

Jan. 28, 1994 (JP) ..... 11-019324

(51) Int. Cl.[7] ..... H01Q 1/24; H01Q 1/36

(52) U.S. Cl. ..... 343/702; 343/700 MS; 343/725; 343/895

(58) Field of Search ..... 343/702, 700 MS, 343/895, 725

(56) References Cited

U.S. PATENT DOCUMENTS 5,734,351 * 3/1998 Ojantakanen et al. ..... 343/702
5,995,064 * 11/1999 Yanagisawa et al. ..... 343/702
6,016,130 * 1/2000 Annamaa ..... 343/895
6,069,592 * 5/2000 Wass ..... 343/702
6,081,242 * 6/2000 Wingo ..... 343/860

OTHER PUBLICATIONS

WO 95/12224.

* cited by examiner

*Primary Examiner*—Don Wong
*Assistant Examiner*—Hoang Nguyen
(74) *Attorney, Agent, or Firm*—Pearne & Gordon LLP

(57) ABSTRACT

The present invention is for providing an antenna device in a portable radio, capable of transmitting and receiving in frequency bands used in two different communication systems without the performance irregularity even in the case of the mass production. By having the inductance per unit length along the elongating direction of the upper antenna element larger than that of the lower antenna element, the entire antenna element is resonated at a first frequency $f_1$ as a quarter wave ground antenna element and is also resonated at a second frequency $f_2$ lower than the frequency three times as much as the first frequency $f_1$ as a three quarter wave ground antenna. Since the antenna element is formed with an antenna pattern printed on a printed wiring board, antenna elements with the same shape can be obtained, and thus the antenna performance irregularity cannot be generated even in the case of the mass production.

10 Claims, 5 Drawing Sheets

ANTENNA DEVICE

BACKGROUND OF THE INVENTION

The present invention relates to an antenna device provided for a portable radio, such as a portable phone (cellular phone), and in particular to an antenna device capable of transmitting and/or receiving data in two different frequencies.

International Publication WO95/12224 discloses an antenna device provided for a portable radio, such as a portable phone, which can be used during carriage. The antenna device resonates at two different frequencies to make it possible to use the portable radio in a plurality of frequency bands.

The antenna device 100 will be explained with reference to FIGS. 7 to 9. As shown in FIG. 7, the antenna device 100 comprises a fixed antenna part 103 including a first helical antenna element 101 and a second helical antenna element 102. Each of the first helical antenna element 101 and the second helical antenna element 102 is made up of a pair of loading coils wound spirally around a cylindrical insulated sleeve 104. The pairs of the loading coils are further wound spirally together.

The base end of each helical antenna element 101, 102 is connected with a conductive sleeve 105 mounted on the lower end of the insulated sleeve 104 so as to be connected electrically with a transmitting and receiving circuit of a portable radio (not illustrated) via the conductive sleeve 105.

FIG. 8 is an equivalent circuit diagram of the fixed antenna part 103. The first helical antenna element 101 and the second helical antenna element 102 are resonated at different resonant frequencies $f_{11}$, $f_{12}$ according to the connection with the conductive sleeve 105. Accordingly, as shown in FIG. 9, the fixed antenna part 103 is capable of transmitting or receiving data in a frequency band wider than that of an antenna to be resonated at a frequency $f_{10}$ (shown by the chain line in the figure).

The antenna device 100 is also provided with a sliding antenna part 107 made up of a bar-like rod antenna element covered with an insulated cover 106 in the upper part. The sliding antenna part 107 is insertable into the insulated sleeve 104 and the conductive sleeve 105, and used as a whip antenna resonated at a frequency $f_{10}$ when the sliding antenna part 107 is pulled out from the portable radio so as to connect the lower end thereof electrically with the conductive sleeve 105.

Therefore, the antenna device 100 is capable of transmitting or receiving data in either of a state where the sliding antenna part 107 is stored and a state where it is pulled out. As shown in FIG. 9, a radio signal can be transmitted or received in a wide band including the two frequencies $f_{11}$, $f_{12}$ in either state.

On the other hand, frequency bands to be used in recent mobile communication equipment differ. For example, it is a 900 MHz band for portable phones and automobile phones, and it is a 1.9 GHz band for PHS (Personal Handy-phone System). Therefore, a portable radio usable in either communication system is desired so that an antenna device compatible with dual bands, capable of transmitting or receiving data in either band is required.

The antenna device 100 achieves transmission and receipt in a wide band according to the fixed antenna part 103 by adjusting the two helical antenna elements to be resonated at the two comparatively close frequencies $f_{11}$, $f_{12}$. Therefore, the antenna device 100 cannot meet the above-mentioned requirement. In order to meet the requirement with the configuration the same as the antenna device 100, two helical antenna elements 101, 102 having different expanded lengths need to be connected parallel and directed outward with respect to the conductive sleeve 105, corresponding with two completely different frequency bands $f_1$, $f_2$ so that the appearance of the portable radio is spoiled as well as the number of parts is increased to complicate the assembly.

In order to solve the problem, the applicant has proposed an antenna device 110 to be resonated at completely different frequency bands $f_1$, $f_2$ by providing two helical antennas 112, 113 connected in series on a feeding metal fixture 111 to elongate linearly and adjusting the expanded length and the winding pitch of each helical antenna as shown in FIG. 10 (Japanese Patent Application No. 10-164616).

However, the antenna device 110, which is required to form helical antennas 112, 113 such that they are resonated in the two respective bands $f_1$, $f_2$ to be used, involves a problem in that a processing step of the loading coils is needed, and thus it is difficult to mass-produce a helical antenna with the designed value but the resonant frequency can be irregular per each antenna device 110.

SUMMARY OF THE INVENTION

The invention is for solving the problems, and an object thereof is to provide an antenna device capable of transmitting or receiving in a portable radio in the frequency bands used in two different communication systems without the performance irregularity even in the case of the mass production.

In order to solve the problems, a first aspect of the antenna device comprises a feeding metal fixture mounted on a housing of a portable radio, and an antenna element provided elongating linearly on the feeding metal fixture, comprising an upper antenna element and a lower antenna element connected electrically in series, with the base end of the lower antenna element connected electrically with the feeding metal fixture, wherein the antenna element is resonated at a first frequency $f_1$ as a quarter wave ground antenna, and the antenna element is resonated at a second frequency $f_2$ lower than the frequency three times as much as the first frequency $f_1$ as a three quarter wave ground antenna by having the inductance per unit length along the linearly elongating direction of the upper antenna element larger than the inductance per unit length along the same direction of the lower antenna element.

The quarter wave antenna element to be resonated at the first frequency $f_1$ can also be resonated at the second frequency $f_2$ lower than the frequency three times as much as the first frequency $f_1$ as a three quarter wave ground antenna by having the inductance per unit length along the elongating direction of the upper antenna element larger than the inductance per same unit length of the lower antenna element so that the SWR hardly changes even if it is used as it is. Therefore, by adjusting the inductance per unit length along the elongating direction of the upper antenna element to be larger, the antenna element having one end connected with the feeding metal fixture can be resonated at optional first frequency $f_1$ and second frequency $f_2$ so as to provide a portable radio capable of transmitting or receiving in two different frequency bands.

In a second aspect of the antenna device, the upper antenna element and the lower antenna element are formed with an antenna pattern printed on a printed wiring board in a bent shape.

Since the antenna pattern is printed on the printed wiring board in a bent shape, it functions as an antenna, and thus it can provide an antenna element in place of the loading coil.

Since parts of the antenna element can be formed by printing on a printed wiring board, antenna patterns with the same shape can be obtained accurately by an etching step without the performance irregularity even in the case of the mass production.

Moreover, since the shape can hardly be deformed even against external force, the antenna characteristics can be maintained stably.

In a third aspect of the antenna device, the upper antenna element is formed with a loading coil, the lower antenna element is formed with an antenna pattern printed on a printed wiring board in a bent shape, and the base end of the loading coil is connected with the tip of the antenna pattern.

Since the lower antenna element can be formed by printing on a printed wiring board, antenna patterns with the same shape can be obtained accurately after an etching step without the performance irregularity even in the case of the mass production.

Since the upper antenna element is formed with a loading coil, a sufficient effective capacity can be ensured even with a short length so that the entire length of the antenna element can be formed shorter than the case having the entirety of the upper antenna element and the lower element formed with an antenna pattern.

In a forth aspect of the antenna device, the first frequency $f_1$ is included in a frequency band in the vicinity of 900 MHz to be used in a portable phone, and the second frequency $f_2$ is included in a frequency band in the vicinity of 1,900 MHz to be used in a PHS.

Accordingly, the portable radio can be used both as a portable phone and a PHS by only projecting an antenna element from the portable radio.

The present disclosure relates to the subject matter contained in Japanese patent application No. Hei. 11-19324 (filed on Jan. 28, 1998), which is expressly incorporated herein by reference in its entirety.

DESCRIPTION OF THE PREFERRED EMBODIMENT

Figure 1:
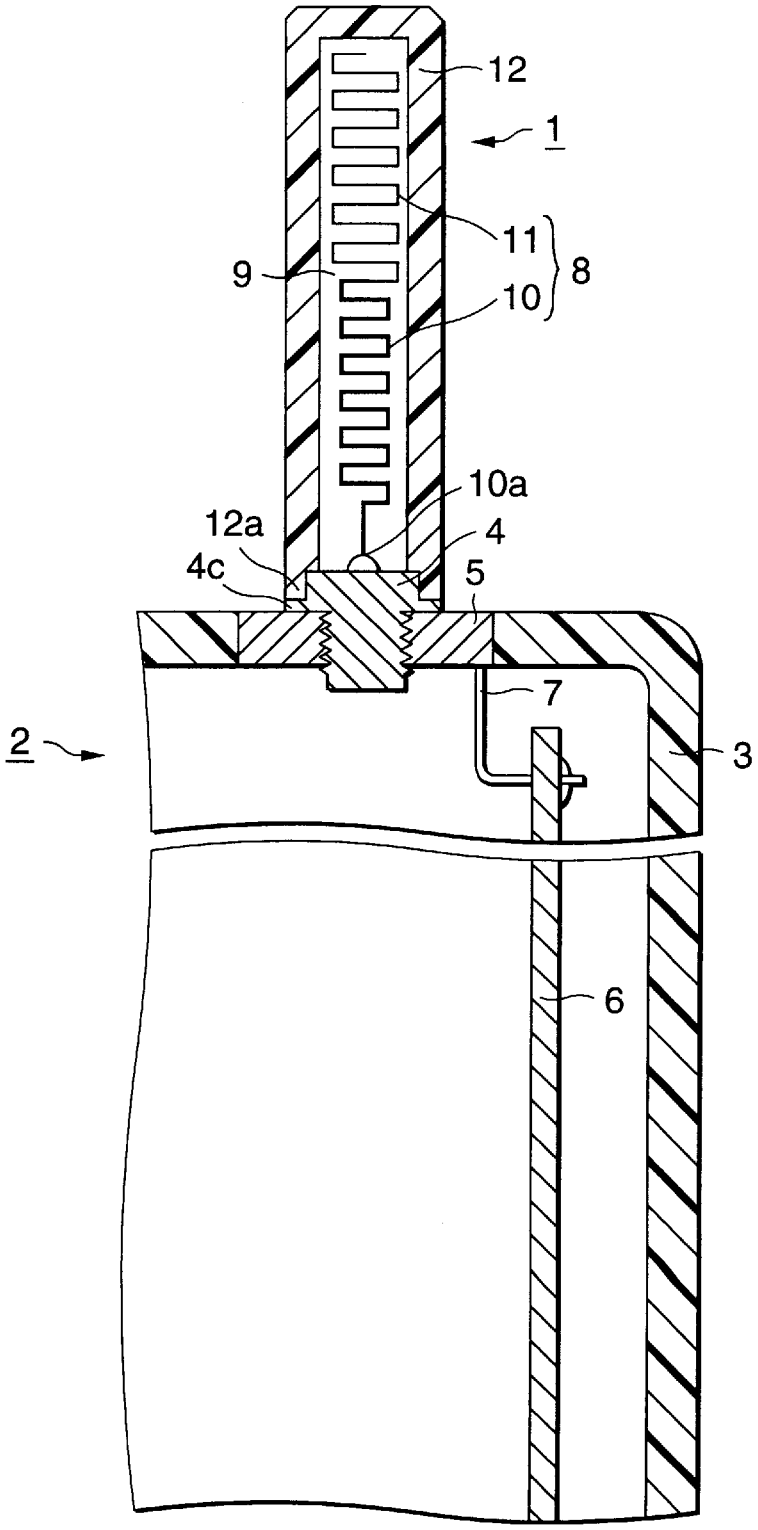
FIG. 1 is a cross-sectional view of a principal part of a portable radio 2 with an antenna device 1 according to a first embodiment of the invention mounted.
Figure 2A:
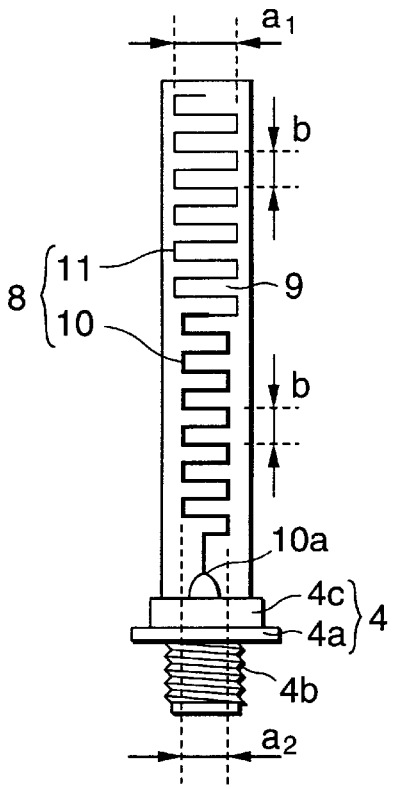
FIG. 2A is a plan view of the antenna device 1.
Figure 2B:
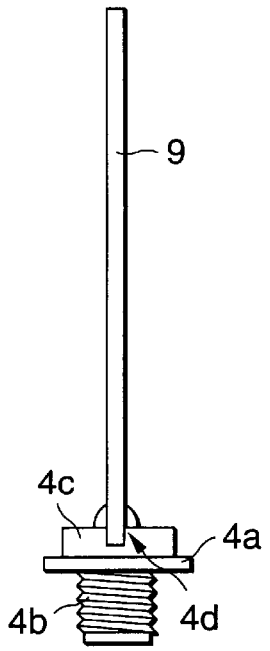
FIG. 2B is a side view thereof.
Figure 3:
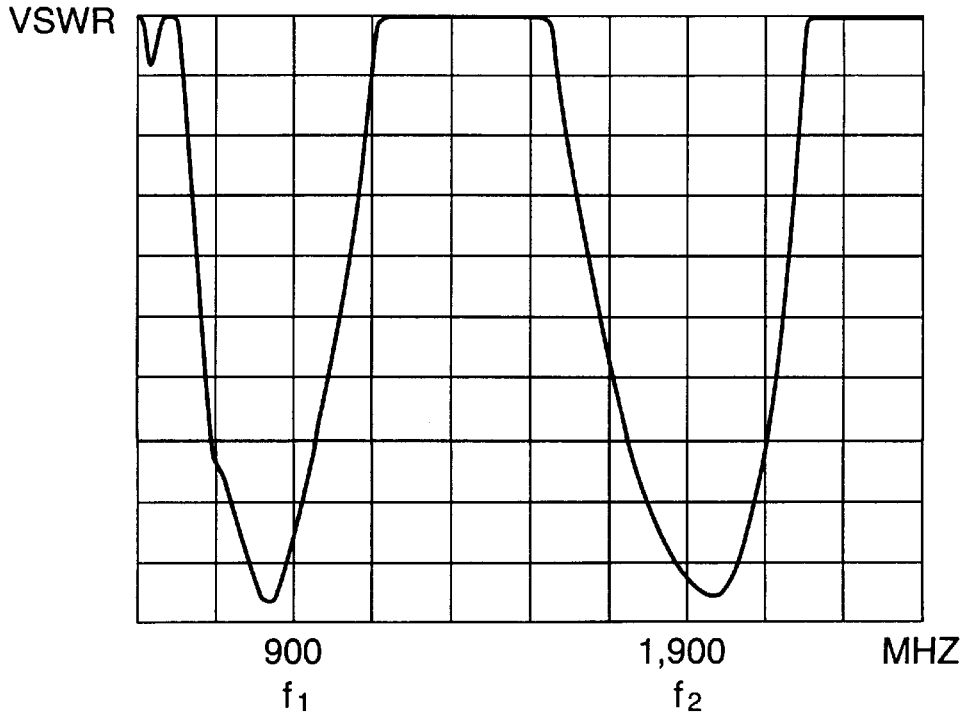
FIG. 3 is a characteristic graph showing the frequency characteristic of the antenna device 1.

Hereinafter the antenna device 1 according to the first embodiment of the invention will be explained with reference to FIGS. 1 to 3. FIG. 1 is a cross-sectional view of the principal part of a portable radio 2 mounted with the antenna device 1. FIG. 2A is a plan view of the antenna device 1, FIG. 2B is a side view thereof, and FIG. 3 is a characteristic graph showing the frequency characteristic of the antenna device 1.

As shown in FIG. 1, the antenna device 1 according to this embodiment is mounted upright perpendicularly from a housing 3 by screwing a feeding metal fixture 4 provided on the base end into a mounting ring 5 mounted on the housing 3 of the portable radio 2.

A circuit board 6 with high frequency circuit parts (not illustrated) comprising a transmitting circuit, a receiving circuit, and an antenna connecting circuit of the portable radio 2 mounted therein is accommodated in the housing 3 of the portable radio 2. The feeding metal fixture 4 screwed in the mounting ring 5 is connected electrically with the antenna connecting circuit by a feeding line 7 for connecting the lead pattern of the circuit board 6 and the mounting ring 5.

As shown in FIG. 2A, the antenna device 1 comprises the feeding metal fixture 4 and a rectangular printed wiring board 9 with an antenna pattern printed thereon so as to serve as the antenna element 8.

The feeding metal fixture 4, which is a substantially columnar metal fixture, has a male screw part 4*b* to be screwed into the mounting ring 5 is formed in the lower part of a flange part 4*a*, and a columnar part 4*c* is formed integrally in the upper part thereof as shown in FIG. 2B. A slit 4*d* is formed concavely on the upper surface of the columnar part 4*c* so as to fit the lower end of the printed wiring board 9 into the slit 4*d* for supporting the printed wiring board 9 upright perpendicularly. Further, the base end of a lower antenna element 10 printed on the printed wiring board 9 described later is soldered onto the feeding metal fixture 4 in the supported state.

As shown in FIG. 2A, the antenna pattern, which comprises patterns bent into a U-shape provided facing with each other continuously so as to obtain predetermined effective inductance and effective capacity, is printed on the surface of the printed wiring board 9 meandering along the longitudinal direction thereof.

The antenna element 8 has the antenna pattern shape designed so as to be resonated at a first frequency $f_1$ with a quarter wavelength as a quarter wave ground antenna, and is resonated at a second frequency $f_2$ lower than the frequency three times as much as the first frequency $f_1$ as a three quarter wave ground antenna when the base end part 10*a* of the lower antenna element 10 is grounded.

Figure 6:
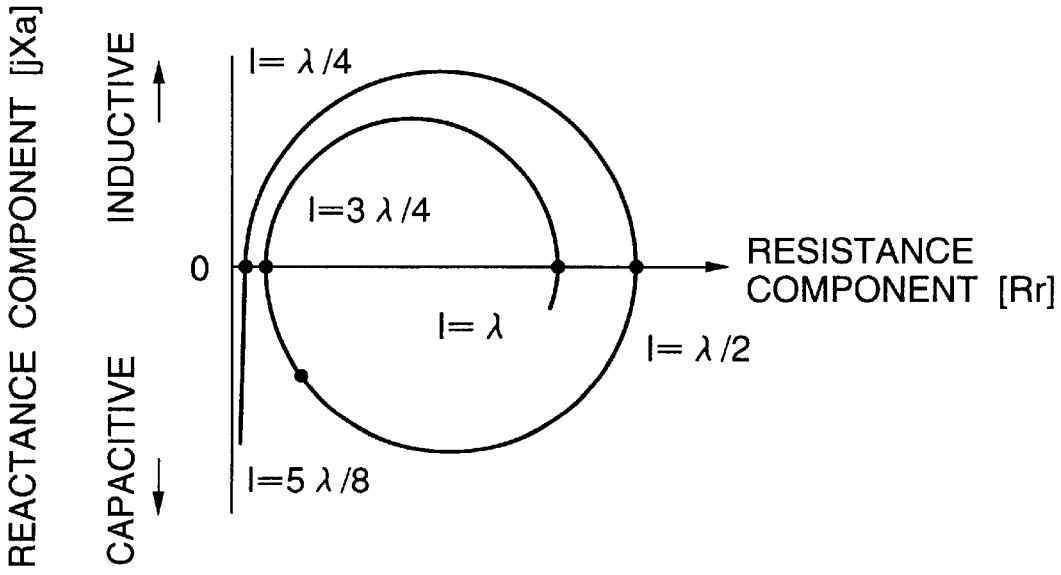
FIG. 6 is an impedance line drawing of the whip antenna.
Figure 7:
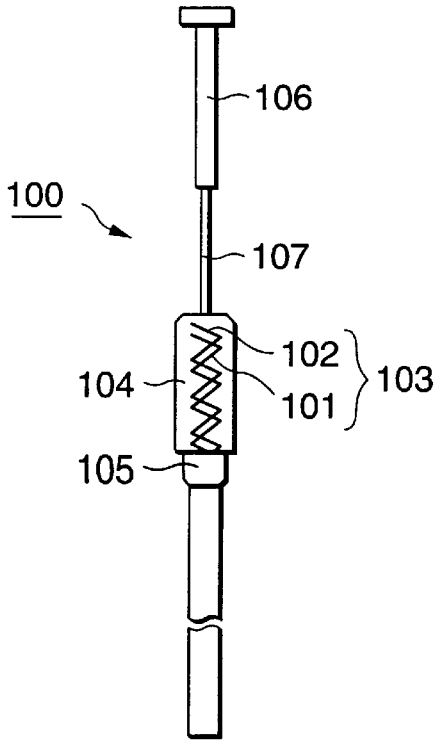
FIG. 7 is a partially-omitted plan view showing an antenna device 100.
Figure 8:
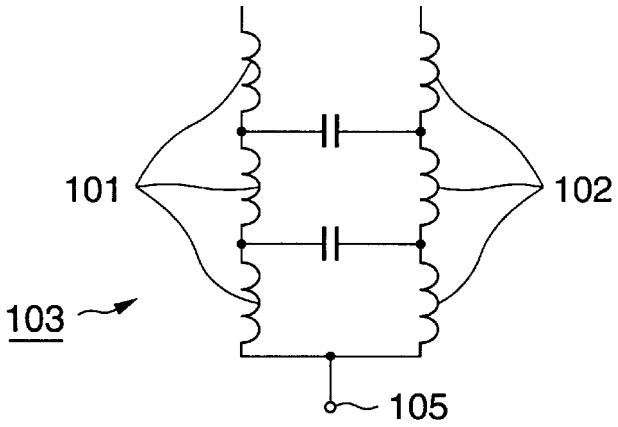
FIG. 8 is an equivalent circuit diagram of the antenna device 100.
Figure 9:
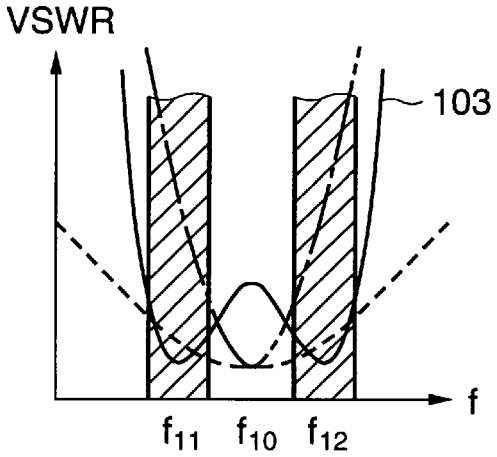
FIG. 9 is a characteristic graph showing the frequency characteristic of the antenna device 100.
Figure 10A:
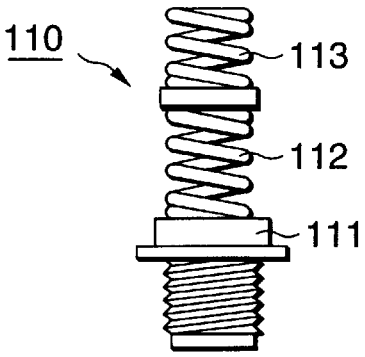
FIG. 10A is a plan view of an antenna device 110 comprising a helical antenna to be resonated at different frequency bands $f_1$, $f_2$.
Figure 10B:
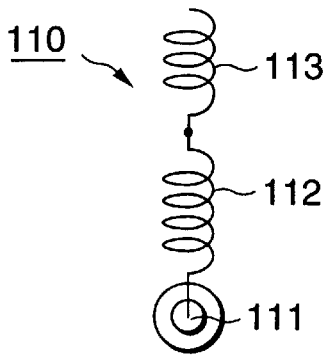
FIG. 10B is an equivalent circuit diagram thereof.

FIG. 6 is an input impedance line graph of a whip antenna having $l/\lambda$ ($l$ is the length of the conductor of the antenna, and $\lambda$ is the wavelength) as the parameter. As shown in the figure, in general, a quarter wave antenna to be resonated at the first frequency $f_1$ becomes closer to the basic impedance with respect to the second frequency $f_2$, which is three times as much as the first frequency $f_1$, and thus the SWR hardly changes even if it is used as the three quarter wave antenna as it is. On the other hand, the larger the tip (upper) side of the inductance per unit length along the elongating direction of the antenna element 8 than the ground (lower) side, the lower the second frequency $f_2$ with respect to the frequency three times as much as the first frequency $f_1$ becomes. Therefore, by adjusting the upper and lower antenna patterns, the antenna element 8 can be resonated at optional different first frequency $f_1$ and second frequency $f_2$.

In this embodiment, the shape of the antenna pattern is determined such that the antenna element 8 is resonated at either 900 MHz as the first frequency $f_1$ and 1,900 MHz as the second frequency $f_2$, which is lower than the frequency three times as much as the first frequency $f_1$ so that the portable radio 2 mounted with the antenna device 1 can be used either as a portable phone having 900 MHz as the frequency band and as a PHS having 1,900 MHz as the frequency band.

Therefore, by having the upper part of the continuous antenna pattern with the meandering shape as the upper antenna element 11 and the lower part as the lower antenna element 10, and having the pattern widths and the lengths thereof differently, the inductance per unit length along the elongating direction of the upper antenna element 11 (longitudinal direction of the printed wiring board 9) is made larger than the inductance per unit length of the lower antenna element 10 in the same direction. That is, as shown in FIG. 2A, the antenna pattern of the upper antenna element 11 has a 0.4 mm pattern width and a 5.5 mm pattern lateral width ($a_1$ in the figure), and the pattern of the lower antenna element 10 has a 0.8 mm pattern width and a 5 mm pattern lateral width ($a_2$ in the figure) so that the inductance per unit length along the elongating direction of the former is made larger. Both of them have the pattern pitch (b in the figure) of 3 mm and the number of bending in a U-shape in 6 times.

FIG. 3 is a graph showing the relationship between the frequency and the voltage standing wave ratio (VSWR) of the antenna element 8 having such an antenna pattern shape, with the base end part 10*a* of the lower antenna element 10 grounded. As shown in the figure, the antenna element 8 is resonated at the 900 MHz first frequency $f_1$ and the 1,900 MHz second frequency $f_2$.

In FIG. 1, numeral 12 is a cylindrical insulated cap with the bottom surface opened, which is made from a synthetic resin such as a hard plastic for covering the entirety of the antenna device 1 and protecting the printed wiring board 9 and the antenna element 8 from the external force. The base end part 12*a* of the insulated cap 12 is fixed to the feeding metal fixture 4 with an adhesive so as to be mounted on the flange part 4*c* of the feeding metal fixture 4.

As shown in FIG. 1, the antenna device 1 accordingly formed is mounted on the housing 3 of the portable radio 2 by screwing the feeding metal fixture 4 into the mounting ring 5, with the antenna element 8 provided elongating linearly upward above the feeding metal fixture 4 as well as the base end part 10*a* thereof is connected electrically with the antenna connecting circuit on the circuit board 6 via the feeding metal fixture 4, the mounting ring 5, and the feeding line 7.

Accordingly, the antenna element 8 is resonated at the first frequency $f_1$ of 900 MHz and the second frequency $f_2$ of 1,900 MHz as a quarter wave and three quarter wave ground antenna as mentioned above so that the portable radio 2 can be used both as a portable phone and a PHS.

Since the antenna element 8 is formed with an antenna pattern to be obtained by an etching step of the printed wiring board 9, the same antenna elements 8 can be formed with a high size accuracy, and thus the antenna devices 1 without the antenna characteristic irregularity can be mass-produced.

Moreover, since a bending process of wires is not required in producing a loading coil in the production step of the antenna element 8, the antenna device 1 can be produced at a low cost.

Although the entirety of the antenna element 8 is formed with the antenna pattern of the printed wiring board 9 in the first embodiment, the upper antenna element 21 can be formed with a loading coil.

Figure 4A:
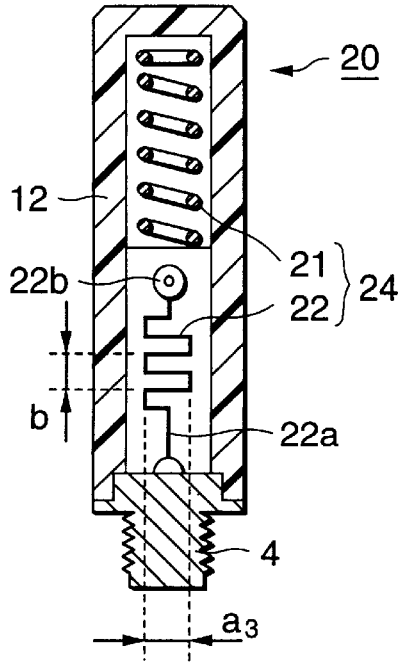
FIG. 4A is a vertical cross-sectional view of an antenna device according to a second embodiment of the invention.
Figure 4B:
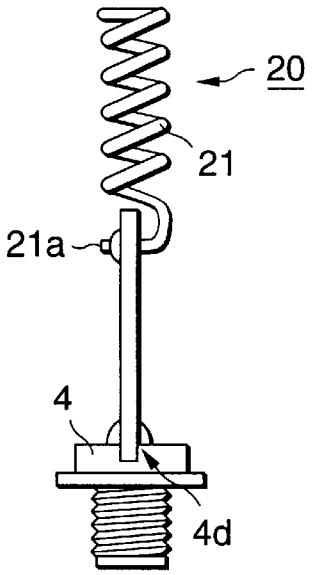
FIG. 4B is a side view thereof.

FIGS. 4A and 4B show an antenna device 20 according to the second embodiment having the upper antenna element 21 formed with a loading coil. FIG. 4A is a vertical cross-sectional view thereof, and FIG. 4B is a side view thereof. Since the configuration of the feeding metal fixture 4, the insulated cap 12, and the portable radio is the same as the first embodiment, explanation thereof is not provided here.

Also in this second embodiment, the shape of the upper antenna element 21 and the lower antenna element 22 is determined such that the portable radio mounted with the antenna device 20 is resonated at the first frequency $f_1$ of 900 MHz and the second frequency $f_2$ of 1,900 MHz, which is lower than the frequency three times as much as the first frequency $f_1$ so as to be used both as a portable phone and a PHS.

The lower antenna element 22 is formed with an antenna pattern printed on the surface of a printed wiring board 23 as in the first embodiment, with patterns bent into a U-shape provided facing with each other continuously meandering along the longitudinal direction of the printed wiring board 23.

The base end part 22*a* of the antenna pattern is connected by soldering with the feeding metal fixture 4 at the time of fitting the printed wiring board 23 into the slit 4*d* of the feeding metal fixture 4. The upper end thereof provides a land part 22*b* formed like a ring around a through hole formed through the printed wiring board 23.

As shown in FIG. 4B, the loading coil to be the upper antenna element 21 is connected at the lower end 21*a* to be inserted into the through hole by soldering with the land part so as to be supported upright on the printed wiring board 23. According to the soldering connection, the upper antenna element 21 and the lower antenna element 22 are provided elongating linearly in the vertical direction as well as connected electrically in series.

Concrete values are found by cut and try for the entirety of the antenna element 24 comprising the upper antenna element 21 and the lower antenna element 22 such that it is resonated at the first frequency $f_1$ and the second frequency $f_2$. In this embodiment, for example, as shown in FIG. 4A, the antenna pattern 22 has a 0.6 mm pattern width and a 4.8 mm pattern lateral width ($a_3$ in the figure), a 3 mm pattern pitch (b in the figure), and 2.5 times of bending in a U-shape. The loading coil 21 is provided by winding a 1 mm line diameter piano wire so as to have a 6 mm outer diameter, a 2.8 mm winding pitch, and 5.25 times of winding.

By winding the loading coil accordingly, the inductance per unit length in the elongating direction thereof (direction along the winding axis of the loading coil) can be a value larger than the inductance per unit length in the elongating direction of the antenna pattern (longitudinal direction of the printed wiring board 23).

Moreover, by having a loading coil as the upper antenna element 21, the inductance per unit length and the effective capacity along the elongating direction can be made larger than those of the antenna pattern, an antenna element with a short length along the elongating direction can be provided.

Figure 5:
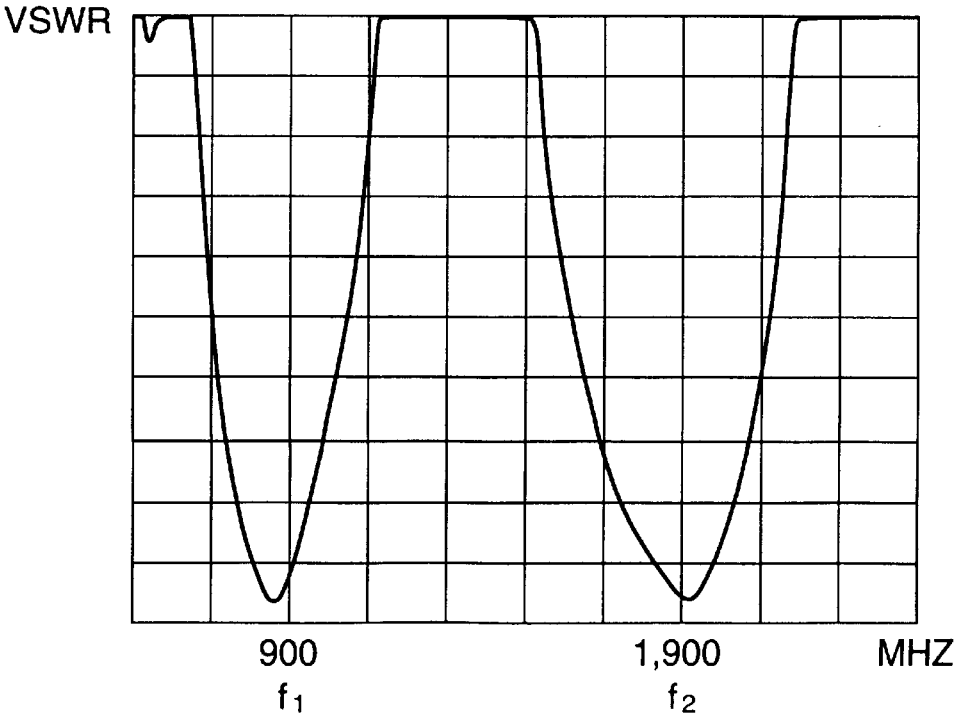
FIG. 5 is a characteristic graph showing the frequency characteristic of the antenna device.

FIG. 5 is a graph showing the relationship between the frequency and the voltage standing wave ratio (VSWR) of the antenna element 24 having the upper antenna element 21 comprising the loading coil, with the base end part 22*a* of the lower antenna element 22 grounded. As shown in the figure, the antenna element 24 is resonated at the 900 MHz first frequency $f_1$ and the 1,900 MHz second frequency $f_2$. As is apparent from the comparison with FIG. 3, the result is similar to the antenna characteristic of the antenna device 1 of the first embodiment. However, since the upper antenna element 21 is provided with the loading coil in the antenna device 20 according to this embodiment, the same antenna characteristic can be obtained with the antenna device 20 with a shorter length compared with the antenna device 1 according to the first embodiment.

Furthermore, since the loading coil is used only for the part of the antenna element 21, the antenna characteristic irregularity generated in the processing step is small.

The present invention is not limited to the above-mentioned embodiments, but can be modified in various ways. For example, the antenna pattern to be printed on the printed wiring board 9, 23 can be a strip line with a conductor layer formed on the rear side of a board comprising a dielectric substance.

Moreover, the shape of the antenna pattern is not limited to a shape bent into a U-shape, but can be formed by bending into another optional shape.

Furthermore, the first frequency $f_1$ and the second frequency $f_2$ at which the antenna device is resonated are not limited to the frequencies mentioned above, but can be other different two frequencies.

According to the first aspect of the invention, an antenna device of a dual mode, resonated at the first frequency $f_1$ and the second frequency $f_2$ to be used in two different communication systems can be provided only by connecting an antenna element with a feeding metal fixture 4.

According to the second aspect of the invention, in addition to the first aspect, since the antenna pattern printed on the printed wiring board 9 comprises the antenna element 8, antenna patterns with the same shape can be obtained, and thus the resonant frequency cannot be irregular even in the case of mass production.

Moreover, since the shape can hardly be deformed even against external force, the antenna characteristics can be maintained stably.

Furthermore, since the processing step of forming a loading coil by bending a wire is not required, an antenna device 1 of a dual band can be produced at a low cost.

According to the third aspect of the invention, since the upper antenna element 21 is formed with a loading coil, a sufficient effective capacity can be ensured even with a short length so that the length of the antenna element 20 can be made shorter than the antenna device according to the second aspect of the invention with the same antenna characteristic.

According to the fourth aspect of the invention, a portable radio 2 can be used both as a portable phone and a PHS by only projecting an antenna element from the portable radio 2.

What is claimed is:

1. An antenna device comprising:

a feeding metal fixture mounted on a housing of a portable radio, and an antenna element provided elongating linearly on the feeding metal fixture, comprising an upper antenna element and a lower antenna element connected electrically in series, a base end of the lower antenna element being connected electrically with the feeding metal fixture, the upper antenna element having an upper pattern lateral width longer than an upper pattern pitch and the lower antenna element having a lower pattern lateral width longer than a lower pattern pitch with the upper and lower pattern lateral widths arranged substantially perpendicular to a longitudinal direction of the antenna element, wherein an upper antenna element pattern width is different from a lower antenna element pattern width so that the inductance per unit length along the linearly elongating direction of the upper antenna element is larger than the inductance per unit length along the same direction of the lower antenna element.

2. The antenna device according to claim 1, wherein the upper antenna element and the lower antenna element are formed with an antenna pattern printed on a printed wiring board in a bent shape.

3. The antenna device according to claim 1, wherein the upper antenna element is formed with a loading coil, the lower antenna element is formed with an antenna pattern printed on a printed wiring board in a bent shape, and the base end of the loading coil is connected with the tip of the antenna pattern.

4. The antenna device according to claim 1, wherein the first frequency $f_1$ is included in a frequency band in the vicinity of 900 MHz to be used in a portable phone, and the second frequency $f_2$ is included in a frequency band in the vicinity of 1,900 MHz to be used in a PHS.

5. An antenna device for a mobile communication system, comprising:

an electrically conductive member;

a first antenna element electrically connected to the electrically conductive member; and a second antenna element electrically connected to the first antenna element so that the first antenna element and the second antenna element are arranged in series, wherein the first antenna element has a first pattern lateral width longer than a first pattern pitch and the second antenna element has a second pattern lateral width longer than a second pattern pitch with the first and second pattern lateral widths arranged substantially perpendicular to a longitudinal direction of the antenna device, wherein at least one of the first and second antenna elements is in the form of an antenna pattern printed on a substrate.

6. The antenna device according to claim 5, wherein a first antenna element pattern width is different from a second antenna element pattern width so that the first antenna element has a first inductance per unit length along a predetermined direction, the second antenna element has a second inductance per unit length along the predetermined direction, and the first inductance is smaller than the second inductance.

7. The antenna device according to claim 6, wherein the first and second antenna elements cooperatively form a quarter wave ground antenna and a three quarter wave ground antenna.

8. The antenna device according to claim 7, wherein the quarter wave ground antenna is resonated at about 900 MHz, and the three quarter wave ground antenna is resonated at about 1,900 MHz.

9. The antenna device according to claim 5, further comprising:

a cylindrical insulated cap storing therein the first and second antenna element, the cap having an opened base end closed by the conductive member.

10. An antenna device comprising:

a feeding metal fixture mounted on a housing of a portable radio, and an antenna element provided elongating linearly on the feeding metal fixture, comprising an upper antenna element and a lower antenna element connected electrically in series, a base end of the lower antenna element being connected electrically with the feeding metal fixture, wherein an upper antenna element pattern width is different from a lower antenna element pattern width so that the inductance per unit length along the linearly elongating direction of the upper antenna element is larger than the inductance per unit length along the same direction of the lower antenna element, so as to permit the antenna element to resonate at a first frequency f1 as a quarter wave ground antenna and at a second frequency f2 lower than a frequency three times as much as the first frequency f1 as a three quarter wave ground antenna.

* * * * *